US007992467B2

(12) United States Patent
Becoat

(10) Patent No.: US 7,992,467 B2
(45) Date of Patent: Aug. 9, 2011

(54) SHINGLE REMOVING APPARATUS

(75) Inventor: Bill Becoat, Alton, IL (US)

(73) Assignee: Adoozie, Inc., Alton, IL (US)

( * ) Notice: Subject to any disclaimer, the term of this patent is extended or adjusted under 35 U.S.C. 154(b) by 140 days.

(21) Appl. No.: 12/020,148

(22) Filed: Jan. 25, 2008

(65) Prior Publication Data

US 2009/0188350 A1 Jul. 30, 2009

(51) Int. Cl.
*E04D 15/02* (2006.01)

(52) U.S. Cl. ..... 81/45; 299/37.1; 30/169

(58) Field of Classification Search ..... 81/45, 46; 299/37.1, 41.1; 30/169, 170
See application file for complete search history.

(56) References Cited

U.S. PATENT DOCUMENTS 4,283,851 A * 8/1981 Wolter ..... 30/134
4,330,938 A * 5/1982 Martin ..... 30/169
4,663,995 A * 5/1987 Amundson et al. ..... 81/45
4,691,439 A * 9/1987 Marra ..... 30/170
4,858,503 A * 8/1989 Dike, Jr. ..... 81/45
5,076,119 A * 12/1991 Wenz ..... 81/45
5,115,628 A * 5/1992 Garter et al. ..... 56/10.2 E
5,197,784 A * 3/1993 Holder ..... 299/37.1
5,218,766 A * 6/1993 Himebaugh ..... 30/170
5,741,047 A * 4/1998 Ordonez ..... 299/37.1
5,772,284 A * 6/1998 Lindsey et al. ..... 299/36.1
5,800,021 A * 9/1998 Derr ..... 299/37.1
5,893,611 A * 4/1999 Gamber ..... 299/41.1
6,095,015 A * 8/2000 Phelan ..... 81/45
6,116,117 A * 9/2000 Nicolosi et al. ..... 81/45
6,128,979 A * 10/2000 Shepherd ..... 81/45
6,585,735 B1 * 7/2003 Frazier et al. ..... 606/51
7,216,567 B1 * 5/2007 Nelson ..... 81/45
7,222,556 B2 * 5/2007 Tyler ..... 81/45
7,318,364 B1 * 1/2008 Nickolas et al. ..... 81/45
7,373,859 B1 * 5/2008 Shirlin et al. ..... 81/45
7,401,861 B2 * 7/2008 Purcell et al. ..... 299/37.1
2003/0181910 A1 * 9/2003 Dycus et al. ..... 606/51
2004/0237740 A1 * 12/2004 Marocco ..... 83/197
2007/0245923 A1 * 10/2007 Galvan ..... 105/280

* cited by examiner

*Primary Examiner* — David B Thomas
(74) *Attorney, Agent, or Firm* — Samuel Digirolamo; Husch Blackwell LLP

(57) ABSTRACT

The present invention discloses a shingle removing apparatus which includes a handle, a stripper member, a drive assembly and a drive linkage assembly with lost motion mechanism. The stripper member is adapted for inserting under a shingle has a first end portion and a second end portion. The drive assembly drives at least a portion of the stripper member and the drive linkage assembly causes at least portion of the stripper member to reciprocally move up and down to thereby remove the shingle. The drive linkage assembly provides a lost motion mechanism which allows the stripper member to intermittently not be driven.

11 Claims, 5 Drawing Sheets

SHINGLE REMOVING APPARATUS

BACKGROUND OF THE INVENTION

The present invention relates to the field of shingle removing apparatus in general, and in particular to a powered shingle removing machine, which is pushed across a shingled roof, and which uses a powered, oscillating blade mechanism to lift and remove previously installed shingles.

Residential and commercial building constructions generally have roof decks which are covered with a protective layer of shingles. Shingles are generally placed in overlapping, aligned rows and the shingles are secured in place by a combination of nails, staples or other fasteners and adhesive.

Any shingle, regardless of type, will eventually deteriorate due to exposure to ultraviolet light from the sun, moisture from precipitation, etc. While it is common to install a second layer of new shingles over a single existing layer, eventually the older shingles must be removed for roof refurbishing. Building codes will typically limit the permissible number of shingle layers. This is a physically demanding task when performed by hand without the use of power machinery. Generally, various manually operated scraping tools, such as modified flat shovels, are used to wedge between the shingles and the underlying roofing paper or sheathing, with the front edge of the shovel shearing or pulling the roofing nails which held the shingles in place and breaking adhesive bonds between shingles. The physical effort involved, particularly when performed on a steep sloping roof, is taxing.

As any roofer is all too well aware, mechanical shingle removing devices substantially reduce the amount of physical exertion that is required to strip shingles from a roof. However, they are also difficult to maneuver on a roof surface due to the fast and continuous oscillating movement of the blade. Thus, the workman must stop the motor to push the machine forward for removing additional shingles, which slows the removal process and increases the cost of removal.

It is therefore desirable to provide a shingle removing apparatus which improves the driving mechanism and improves the time efficiency and workman efficiency for removing shingles.

Accordingly, the present invention is directed to a shingle removing apparatus which overcomes one or more of the problems as set forth above.

BRIEF SUMMARY OF THE INVENTION

The present invention overcomes many of the shortcomings and limitations of the prior art devices discussed above and teaches the construction and operation of several embodiments of a shingle removing apparatus adapted for continuously removing the shingles without having to stop the motor to move removal apparatus. The present apparatus can improve the overall efficiency of the entire shingle removing process as compared to the prior art with respect to work efficiency.

In one aspect of the present invention, the present shingle removing apparatus includes a handle, a stripper member, a drive assembly and a drive linkage assembly with lost motion mechanism. The handle has a proximal end and a distal end. The stripper member is adapted for inserting under a shingle and has a first end portion and a second end portion. The first end portion of the stripper member is operatively coupled to the proximal end of the handle such that the second end portion of the stripper member is reciprocally moveable up and down. The drive assembly drives at least a portion of the stripper member and the drive linkage assembly causes at least a portion at a free end of the stripper member through a lost motion mechanism to reciprocally move up and down to thereby remove shingles. The drive assembly is operatively connected to the stripper member to selectively effect pivoting movement of the stripper member relative to the handle. The lost motion mechanism allows the stripper member to intermittently not be driven. The drive linkage assembly in one embodiment comprises a crank arm, a first link and a second link to provide lost motion connection. The crank is coupled to the drive assembly for rotation thereby.

In another aspect of the present invention, the drive linkage assembly provides a lost motion connection between a crank arm and a link arm. The crank arm is pivotally coupled to the drive assembly. The link arm has first and second end portions, and includes an elongated slot spaced from the second end portion. The crank arm is pivotally associated with the slot so as to provide lost motion connection. The second end portion of the link arm is operatively engaged with the stripper member.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein. Like numbers utilized throughout the various Figures designate like or similar parts or structure.

DETAILED DESCRIPTION OF THE INVENTION

The present invention involves the provisions of a shingle removing apparatus wherein the drive linkage assembly includes a lost motion mechanism that effects intermittent movement of the stripper member during continuous rotation of a crank arm so that an operator does not need to stop a motor to go forward for removing more shingles. The present shingle removing apparatus improves the overall efficiency of the shingle removing job as compared to the prior art apparatus with respect to time efficiency and worker efficiency in removing the shingles.

Figure 1:
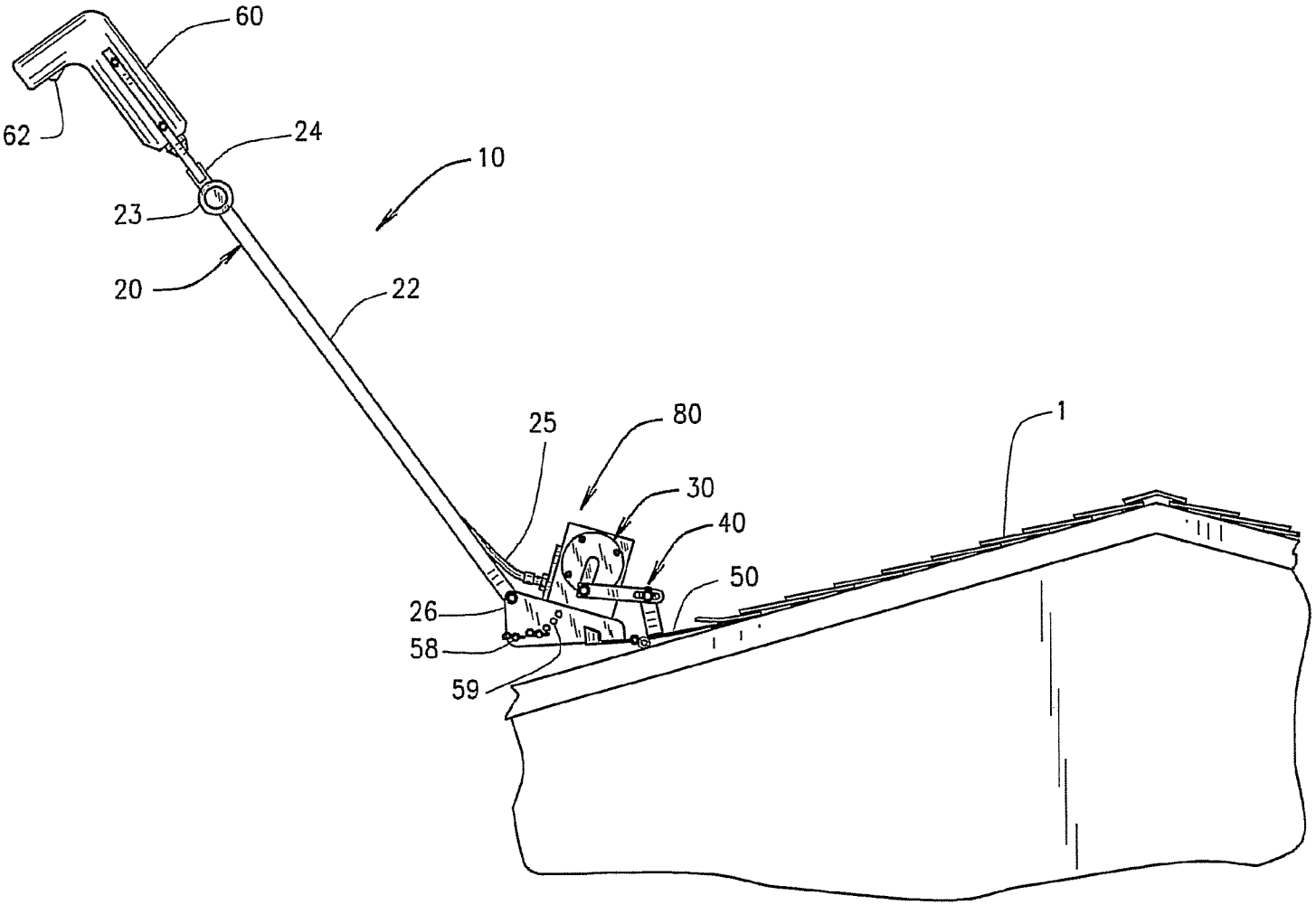
FIG. 1 is a side view of a first embodiment of the present shingle removing apparatus constructed in accordance with the teachings of the present invention.
Figure 2:
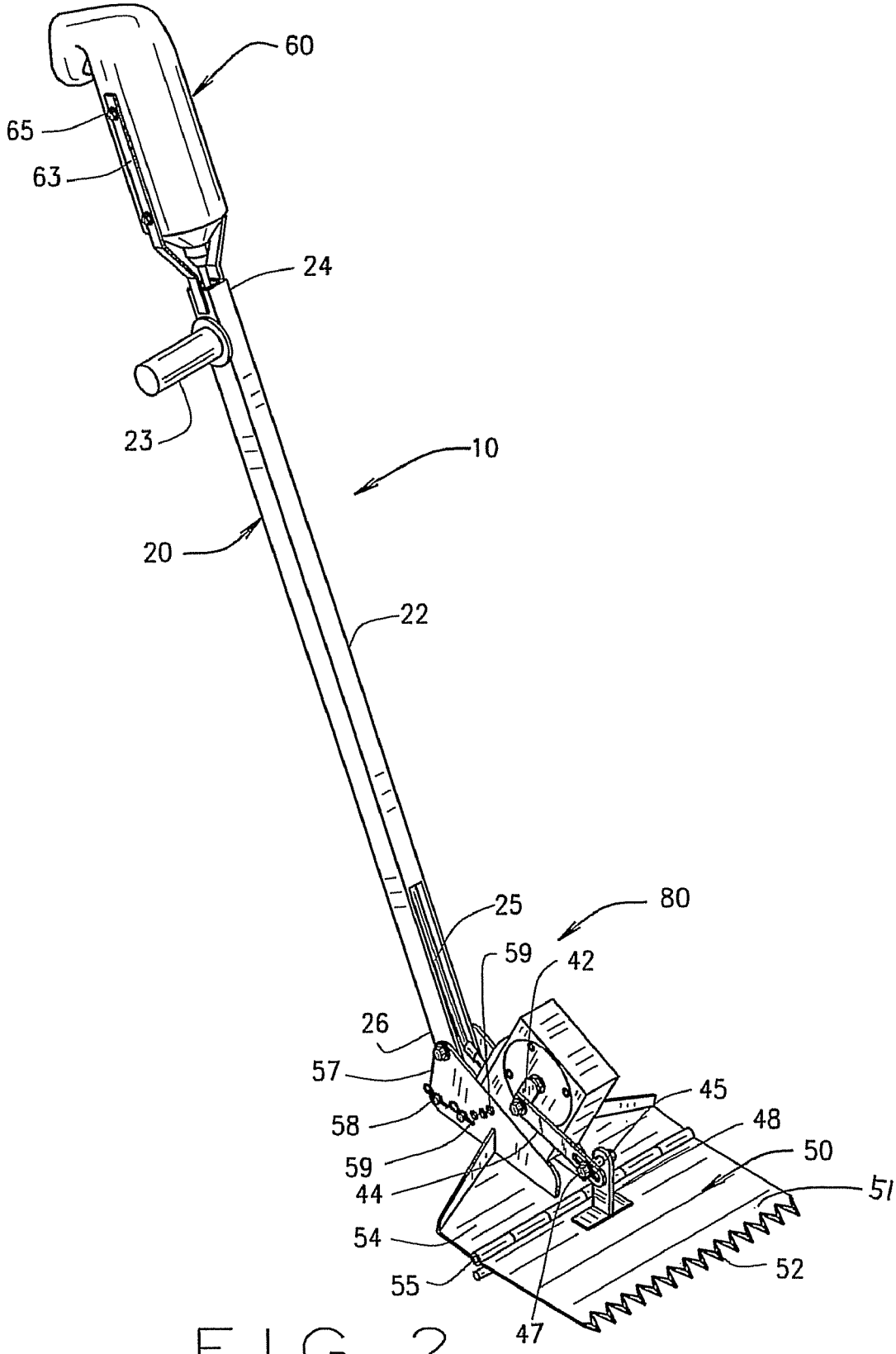
FIG. 2 is a perspective side view of the shingle removing apparatus of FIG. 1.
Figure 3:
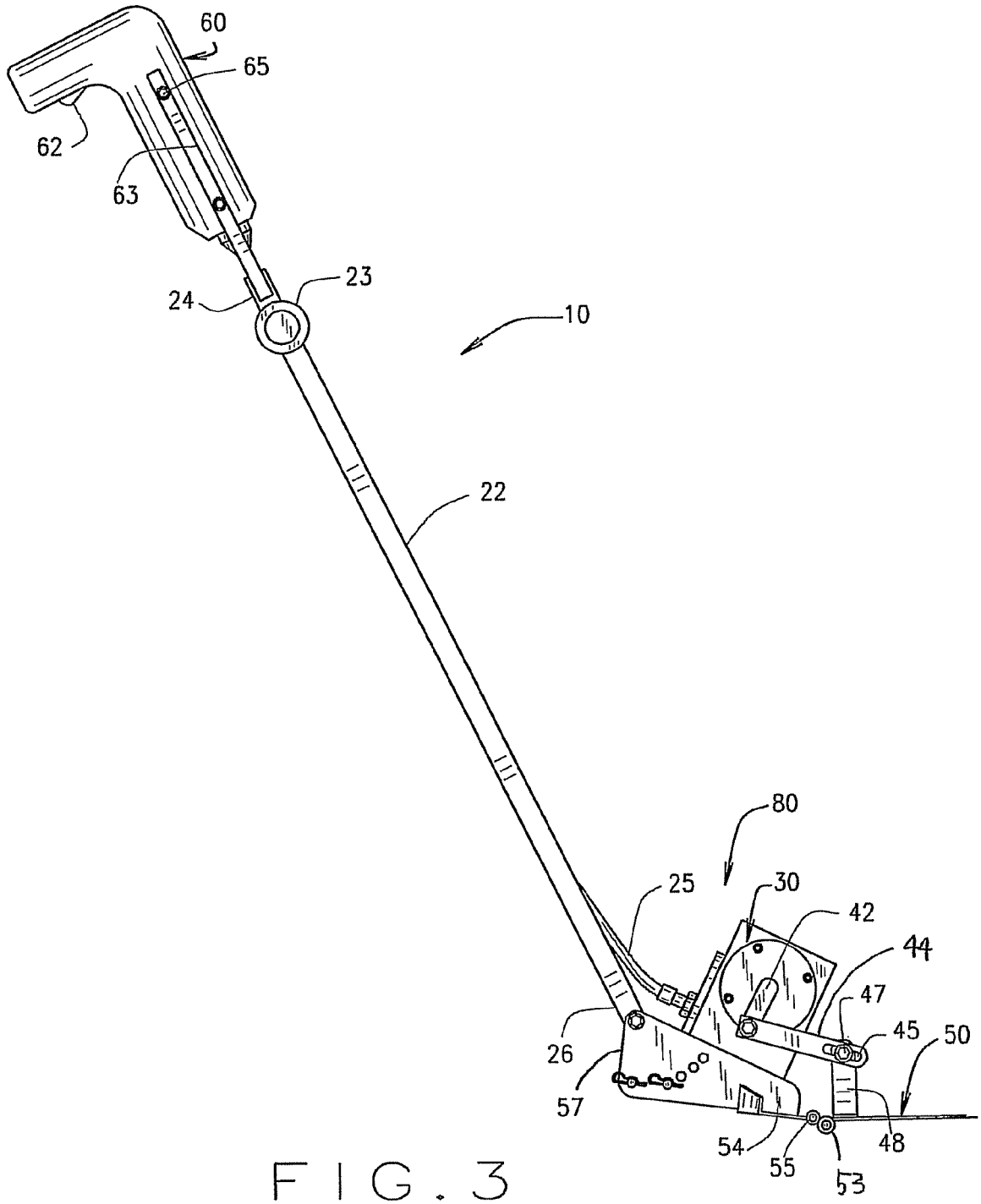
FIG. 3 is a side view of the shingle removing apparatus of FIG. 1.
Figure 4:
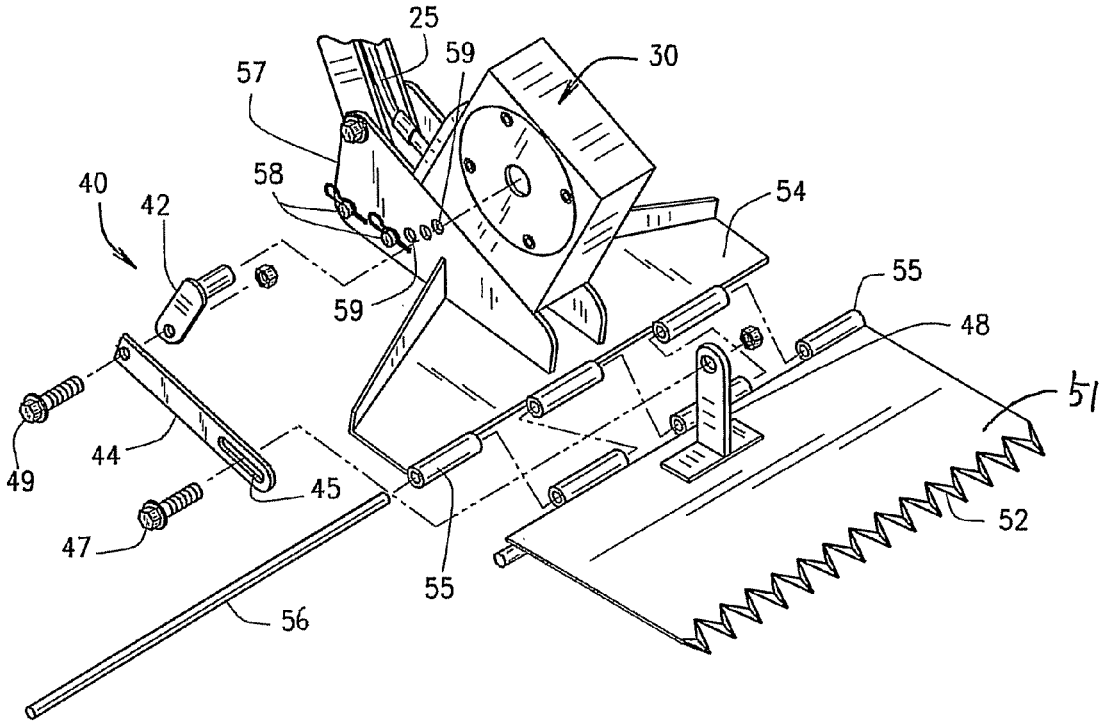
FIG. 4 is an exploded perspective view of the drive link assembly in accordance with the teachings of the present invention.

As best shown in FIGS. 2-4, the shingle removing apparatus 10 comprises a drive system including a drive assembly 80 and a drive linkage assembly 40. The apparatus 10 includes a stripper member 50, such as a stripping blade, preferably having a toothed free end portion 52 for inserting under shingles. The shingle removing apparatus 10 is generally operated by using the drive assembly 80, whereby the stripper member 50 lift nails out of a roofing substrate. As illustrated in FIG. 1, the shingle removing apparatus 10 of the present invention is positioned on the surface from which material is to be removed such as a shingled roof. The operator positions himself or herself behind the shingle removing apparatus 10. The operator grips the handle 20 and may advance the shingle removing apparatus 10 on wheels 53. The shingle removing apparatus 10 is actuated by depressing a trigger 62 which will energize a motor 60 causing a drive shaft 25 to rotate. The drive assembly 80 will effect an oscillatory and reciprocal motion to the stripper member 50 through the drive linkage assembly 40. The operator, by use of the grip 23 and/or handle 20, advances the leading edge 51 of the stripper member 50 beneath the roofing material to be removed. As the leading edge 51 contacts the underside of the shingles 1, the shingles 1 and any fasteners are lifted upwardly along with the fastener such as staples or nails. After the leading edge has lifted a section of shingles 1 from the surface, the operator proceeds forward so that the stripper member 50 is positioned between the next remaining layer of shingles 1 and removal is accomplished in a similar manner.

Referring to the drawings more particularly by reference numbers, the numeral 10 in FIGS. 1-3 identifies one embodiment of a shingle removing apparatus.

In one aspect of the present invention, the shingle removing apparatus 10 includes a handle 20, a drive assembly 80, a drive linkage assembly 40 and a stripper member 50 for forcibly removing shingles 1 as illustrated in FIGS. 1-7. The handle 20 comprises an elongated tubular housing 22, an on/off switch such as a trigger 62 disposed adjacent its distal end portion 24, a transversely extending secondary handle 23 disposed on its intermediate portion and a mount member 54 disposed on its proximal end portion 26. The handle 20 is hollow and can have an internal bearing (not shown) for supporting a drive shaft 25. The stripper member 50 can be a shingle removing blade, which is operatively coupled to the drive assembly 80 for effecting movement of the stripper member 50 relative to the handle 20 through the drive linkage assembly 40. The stripper member 50 is in the form of a plate with teeth 52 on the leading edge 51. The stripper member 50 has a leading edge 51 which engages the shingles and fasteners to be removed. A stripper member 50 has a trailing edge portion and the beveled free end 51.

The shingle removing apparatus 10 is powered by the motor 60 which may be hydraulic, pneumatic or electric with controls suitably located on the handle 20. The motor 60 can be secured to the free end portion 24 of the handle 20 by a bolt 65 and a bracket 63. Alternatively, the motor 60 can be bolted onto suitable motor mount in a motor casing with its controls preferably on the distal end portion of the handle 20. (not shown)

Turning now to FIGS. 2-4, it can be seen that rearwardly extending mounting brackets 57 are provided with an aperture disposed proximate the lower end of the trailing edge of the mounting bracket 57. The mounting brackets 57 are positioned in spaced apart relationship and the proximal end portion 26 of the handle 20 is inserted between the two mounting brackets 57. The mounting brackets 57 are secured to the proximal end portion 26 of the handle 20 by means of latch pins 58, each extending through respective holes 59. A plurality of holes 59 on each mounting bracket 57 permits adjustment of the vertical angular orientation of the handle 20. The mounting brackets 57 include a plurality of aligned holes 59 which allow the operator to adjust angular relationship between the handle 20 and the mount member 54. In one embodiment, the shingle removing apparatus 10 includes an optional wheel unit 53 positioned adjacent the proximal end portion 26 of the handle 20. The wheel unit 53 can include a pair of wheels 53 mounted on an axle which extends through the apertures in the mounting bracket 57 for moving the apparatus 10 about a roof surface. The rearwardly tapered mount member 54 is attached to the mounting bracket 57. In another embodiment, the mount member 54 can be directly connected to the handle 20. The stripper member 50 is pivotally connected to the mount member 54 by means of outer and inner hinge sockets 55 respectively, mounted on a hinge pin 56.

Figure 5:
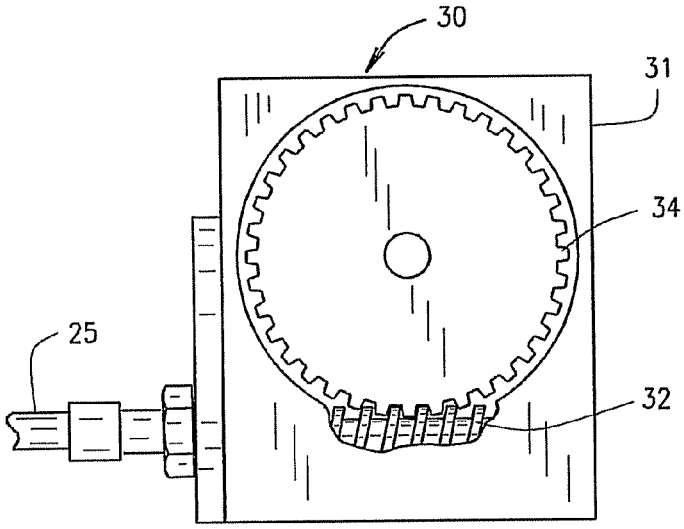
FIG. 5 is a side view of the gear assembly of one housing portion of the shingle removing apparatus of FIG. 1 with portions broken away to show internal detail.

The stripper member 50 is driven by the motor 60 mounted to the handle 20. The drive assembly 80 comprises the motor 60 operatively connected to the drive shaft 25 that can be enclosed by a tubular housing portion 22 of the handle 20 and which extends from the motor 60 to a worm gear 32, as illustrated in FIG. 5. The lower end of the drive shaft 25 connected to a gear assembly 30 including a ring gear 34 and worm gear 32. Preferably, at least the lower portion of the drive shaft 25 is flexible to accommodate the angular adjustment between the handle 20 and the mount member 54, for convenience of construction, the drive shaft 25 can be a flexible drive cable. The drive shaft 25 is operatively coupled to the worm gear 32 in a conventional manner as illustrated in FIG. 5. The worm gear 32 is suitably mounted in a housing 31 and is operatively engaged with a ring gear 34. The motor 60 is actuated by means of the trigger 62. Preferably the motor 60 is a variable speed motor with speed being selected by the trigger 62. In a preferred embodiment the motor 60 is a variable speed drill motor with a chuck coupling the motor 60 to the drive shaft 25.

Figures 6, 7:
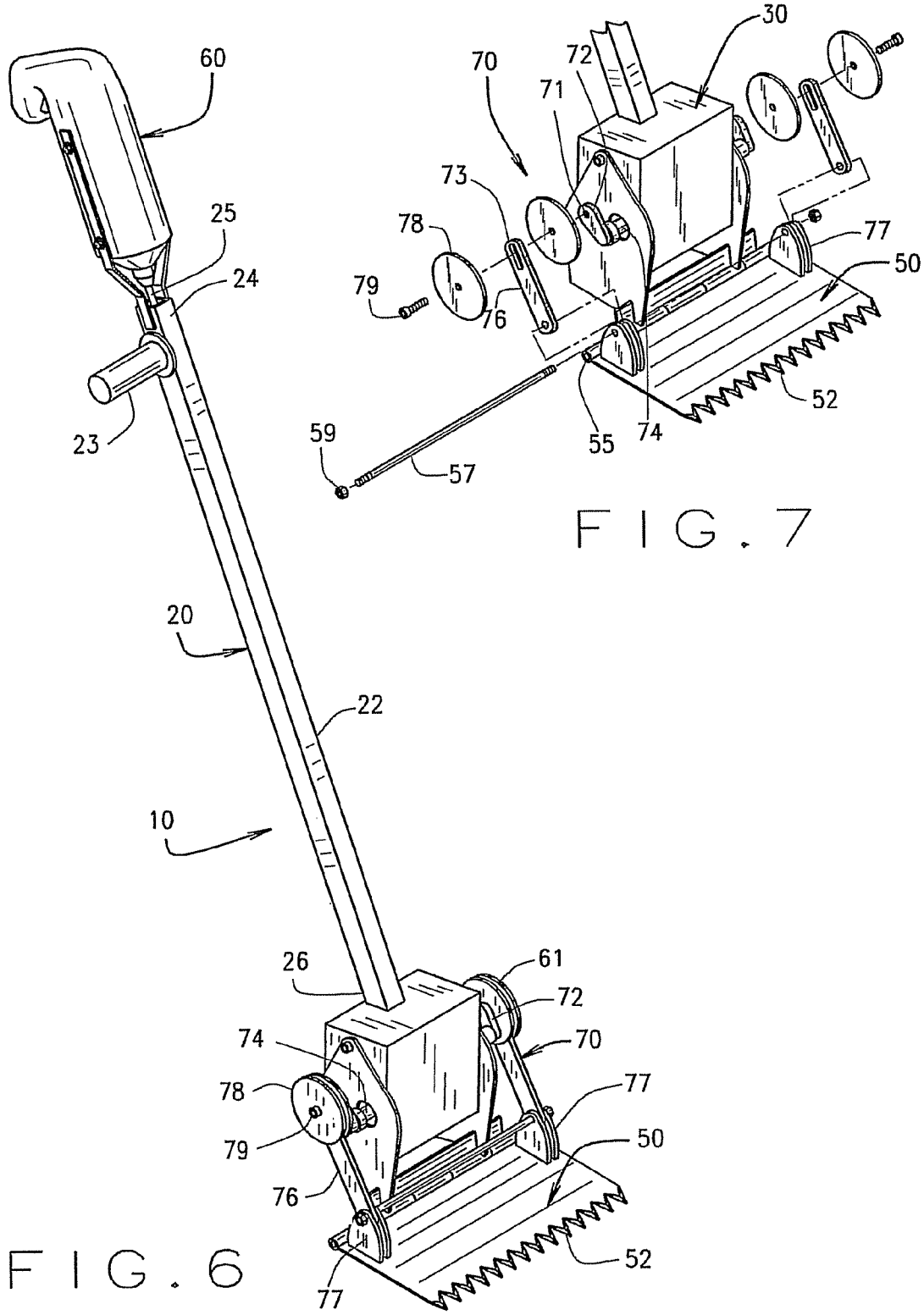
FIG. 6 is a perspective view of another embodiment of the stripper removing apparatus.
FIG. 7 is an exploded perspective view of a drive link assembly.

The drive assembly 80 includes a gear assembly 30 for coupling the drive shaft 25 to drive linkage assembly 40, 70 to effect reciprocative movement of the stripper member 50. The shingle removing apparatus 10 of the present invention includes a drive linkage assembly 40 that provides lost motion oscillating driving of the stripper member 50. The motor 60 drives the drive shaft 25 to ultimately rotate a crank arm 42 as illustrated in FIGS. 4 and 7. It will be understood that the driving mechanism used to translate rotational motion of the drive shaft 25 into rotating motion of the crank arm 42 is not critical, and any driving mechanism known in the art may be used to translate rotational rotation of the drive shaft 25 into rotating motion of the crank arm 42 or the crank arm 72.

The present shingle removing apparatus 10 includes the drive linkage assembly 40 providing preferred lost motion mechanism as illustrated in FIGS. 2-4. In one embodiment, the drive linkage assembly 40 includes the crank arm 42, a first link 44 and a second link 48. The crank arm 42 is positioned on the exterior of the housing 33 and is rotated by the drive assembly 80. The crank arm 42 is adapted for moving the first link 44 which is pivotally connected to the crank arm 42 by means of a pivot pin 49. The first link 44 includes an elongated slot 45 spaced apart from the pivotal connection of the crank arm 42 and the first link 44. The second link 48 includes a follower 47 which is movably received in the elongate slot 45 to form a lost motion pivotal connection. The slot 45 receives the follower 47 for free movement of the follower 47 along the elongated slot 45. The elongated slot 45 has a length sufficient to effect intermittent movement of the stripper member 50 during continuous rotation of the crank arm 42. As a result, the lost motion mechanism delays movement of the stripper member 50 during a predetermined portion of the rotation of the crank arm 42. In this regard, an operator can move the shingle removing apparatus 10 forward without manually stopping the motor due to effect a time delay in the movement of the stripper member to insert it under more shingles 1. When the crank arm 42 is initially rotated by a gear assembly 30, the stripper member 50 is permitted to rotate through a predetermined "lost motion" connection before establishing a direct-drive driving connection therewith to delay lifting or lowering the leading edge 51 of the stripper member 50. Once the direct-drive driving connection is established, further rotation of the crank arm 42 will cause the stripper member 50 to lift or lower. This "lost motion" feature advantageously aids in going forward for removing next shingles. The operator can proceed rapidly and safely as slow return of the stripper member 50 to the set up position is accomplished by the lost motion mechanism. It is preferred that the drive assembly be constructed so that the direct drive portion of a crank arm rotation is preferably adjacent 3 o'clock and 9 o'clock portion of the crank arm 42 to provide mechanical advantage during the lifting movement of the stripper member 50 and less impact from the follower 47 following out at the each of the slot 45.

An alternate embodiment of the shingle removing apparatus 10 of the present invention is shown in FIGS. 6 and 7. The drive linkage assembly 70 includes a crank arm 72 and a link arm 76. The crank arm 72 is pivotally connected to the gear assembly 30 and is rotated by the gear assembly 30. The link arm 76 is pivotally coupled to the eccentric portion 71 of the crank arm 72 by means of a follower 79. The link arm 76 has first end and second end portions, the second end portion being operatively engaged with a second link 77, the first end portion being pivotally connected to the eccentric portion of the crank arm 72. The second link is secured to the upper surface of the stripper member 50. The link arm 76 includes an elongated slot 73 spaced apart from the pivotal connection of the link arm 76 to the second link 77. The crank arm 72 includes the follower 79 which is mounted to and pivotally engaged with the elongated slot 73 through the lost motion connection. The elongated slot 73 receives the follower 79 for free movement of the follower 79 along the elongated slot 73. The elongated slot 73 has a length sufficient to effect intermittent movement of the stripper member 50 during continuous rotation of the crank arm 72. As a result, the lost motion mechanism delays movement of the stripper member 50. The drive linkage assembly 70 further comprises two discs 78 which are positioned in spaced apart relationship with the lost motion connection between the discs to shield a pinch point.

In conclusion, the shingle removing machine greatly facilitates the removal of shingles from a roof. The time delay of the drive arm actuation oscillates and reciprocates the shingle removing blades in an efficient pattern.

Moreover, it will be understood that although the terms first, second and third are used herein to describe various features, elements, regions, layers and/or sections, these features, elements, regions, layers and/or sections should not be limited by these terms. These terms are only used to distinguish one feature, element, region, layer or section from another feature, element, region, layer or section. Thus, a first feature, element, region, layer or section discussed below could be termed a second feature, element, region, layer or section, without departing from the teachings of the present invention.

Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art.

Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow. The scope of the disclosure is not intended to be limited to the embodiments shown herein, but is to be accorded the full scope consistent with the claims, wherein reference to an element in the singular is not intended to mean "one and only one" unless specifically so stated, but rather "one or more." All structural and functional equivalents to the elements of the various embodiments described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims.

What is claimed is:

1. A shingle removing apparatus comprising:

a handle having a proximal end and a distal end;

a stripper member adapted for inserting under a shingle, said stripper member having a first end portion and a second end portion, the first end portion of said stripper member being operatively coupled to the distal end of said handle such that the second end portion of said stripper member is reciprocally moveable up and down;

a drive assembly adapted for driving at least a portion of said stripper member; and a drive linkage assembly with a lost motion mechanism for permitting a predetermined range of free pivotal movement of the drive linkage assembly prior to movement of said stripper member, said drive linkage assembly being operatively connected to said drive assembly and being operatively connected to said stripper member to cause the second end portion of said stripper member to reciprocally move up and down, wherein said drive linkage assembly comprising:

a crank arm being coupled to said drive assembly for rotation thereby;

a first link having first end and second end portions, the first end portion being pivotally connected to one of said crank arm and a second link, said first link including a slot spaced from the pivotal connection; and a second link pivotally associated with said slot so as to permit a predetermined range of free pivotal movement of said first link prior to movement of said second link.

2. The shingle removing apparatus of claim 1 wherein said drive assembly including an electric motor.

3. The shingle removing apparatus of claim 1 wherein said drive linkage assembly including a crank arm and a link arm, one end portion of said link arm being pivotally connected to said crank arm and the other end portion of said link arm being pivotally connected to said stripper member.

4. The shingle removing apparatus of claim 1 wherein said handle including a mount member secured to the proximal end of said handle, the first end portion of said stripper member being pivotally coupled to said mount member such that the second end portion of said stripper member is reciprocally moveable up and down.

5. The shingle removing apparatus of claim 4 further comprising at least one lock pin and a plurality of holes positioned adjacent the proximal end portion of said handle, said at least one lock pin and said plurality of holes being adapted for adjusting an angular relationship between said handle and said mount member.

6. A shingle removing apparatus comprising:

a handle;

a stripper member pivotally associated with the handle;

a drive assembly adapted for driving at least a portion of said stripper member; and a drive linkage assembly operatively connected to said drive assembly; said drive linkage assembly being operatively connected to said stripper member and the drive assembly to selectively effect pivoting movement of the stripper member relative to the handle, said drive linkage assembly including a lost motion mechanism for permitting a predetermined range of free pivotal movement of the drive linkage assembly prior to movement of said stripper member whereby the drive linkage assembly allows the stripper member to intermittently not be driven, wherein said drive linkage assembly comprising:

a crank arm having an eccentric portion, said crank arm pivotally coupled to said drive assembly;

a link arm having first end and second end portions, the link arm including a slot spaced from the second end portion, the second end portion being operatively engaged with said stripper member; and said crank arm being pivotally associated with said slot so as to provide lost motion connection.

7. The shingle removing apparatus of claim 6 wherein said drive assembly including an electric motor.

8. The shingle removing apparatus of claim 6 wherein the drive assembly including a speed reducer with an input shaft adapted for connection to a motor.

9. The shingle removing apparatus of claim 8 including a clamp assembly adjacent an input end of said input shaft and adapted for removably securing an electric drill motor in position for attachment to said input shaft.

10. The shingle removing apparatus of claim 6 wherein said handle including a mount member rigidly secured to the proximal end portion of said handle, the first end portion of said stripper member being pivotally coupled to said mount member such that the second end portion of said stripper member is reciprocally moveable up and down.

11. The shingle removing apparatus of claim 10 further comprising at least one lock pin and a plurality of holes positioned on said mount member, said at least one lock pin and said plurality of holes being adapted for adjusting an angular relationship between said handle and said mount member.

* * * * *